US011970911B2

(12) United States Patent
Brodie et al.

(10) Patent No.: US 11,970,911 B2
(45) Date of Patent: Apr. 30, 2024

(54) DEVICE FOR A STEEL TUBE FOR USE IN A TUBULAR HYDROCARBON COLUMN

(71) Applicant: VALLOUREC OIL AND GAS FRANCE, Aulnoye-Aymeries (FR)

(72) Inventors: Alastair John Brodie, Meudon (FR); Maxime Vannetzel, Meudon (FR)

(73) Assignee: VALLOUREC OIL AND GAS FRANCE, Aulnoye-Aymeries (FR)

( * ) Notice: Subject to any disclaimer, the term of this patent is extended or adjusted under 35 U.S.C. 154(b) by 101 days.

(21) Appl. No.: 17/774,422

(22) PCT Filed: Nov. 4, 2020

(86) PCT No.: PCT/EP2020/080867
§ 371 (c)(1),
(2) Date: May 4, 2022

(87) PCT Pub. No.: WO2021/089576
PCT Pub. Date: May 14, 2021

(65) Prior Publication Data

US 2022/0349263 A1 Nov. 3, 2022

(30) Foreign Application Priority Data

Nov. 7, 2019 (EP) ..... 19207812

(51) Int. Cl.
*E21B 17/02* (2006.01)
*E21B 17/10* (2006.01)

(52) U.S. Cl.
CPC ..... *E21B 17/026* (2013.01); *E21B 17/1035* (2013.01)

(58) Field of Classification Search
CPC ..... E21B 17/026; E21B 17/1035
See application file for complete search history.

(56) References Cited

U.S. PATENT DOCUMENTS 4,422,504 A * 12/1983 Moore ..... F16L 35/00 166/241.7
5,379,836 A * 1/1995 Jordan ..... E21B 17/1035 166/241.6

(Continued)

FOREIGN PATENT DOCUMENTS

CA 2 512 427 A1 7/2004
CN 106968613 A 7/2017

(Continued)

OTHER PUBLICATIONS

International Search Report dated Dec. 10, 2020 in PCT/EP2020/080867 filed on Nov. 4, 2020, 3 pages.

*Primary Examiner* — Nicole Coy
(74) *Attorney, Agent, or Firm* — Oblon, McClelland, Maier & Neustadt, L.L.P.

(57) ABSTRACT

A device for a steel tube designed to be secured on a portion of the tube used in a tubular hydrocarbon column includes a substantially cylindrical envelope extending along a longitudinal axis and designed to surround the box portion of the first steel tube and the envelope forming an opened ring so that a circumferential gap subsists between two free ends of the envelope; and a locking mechanism fixed to the envelope in the vicinity of the circumferential gap and configured to bring the free ends of the envelope closer to each other in a locked position.

23 Claims, 9 Drawing Sheets

(56) References Cited

U.S. PATENT DOCUMENTS

| | | | | |
|---|---|---|---|---|
| 6,322,110 | B1 * | 11/2001 | Banker | E21B 17/0423 285/333 |
| 7,124,818 | B2 * | 10/2006 | Berg | E21B 17/1021 166/250.01 |
| 7,784,537 | B2 * | 8/2010 | Baxter | B21D 43/28 166/241.5 |
| 10,187,190 | B2 * | 1/2019 | Abdelmonem | H04B 17/345 |
| 10,197,190 | B1 | 2/2019 | Neff | |
| 2017/0246778 | A1 | 8/2017 | Trowbridge | |
| 2018/0291713 | A1 * | 10/2018 | Jeanson | E21B 43/11 |
| 2018/0355679 | A1 * | 12/2018 | Gruber | F16L 3/04 |

FOREIGN PATENT DOCUMENTS

| | | | |
|---|---|---|---|
| GB | 2 201 177 | A | 8/1988 |
| GB | 2477357 | A | 8/2011 |
| GB | 2572832 | A | 10/2019 |
| WO | WO 93/20327 | A1 | 10/1993 |
| WO | WO 2016/198863 | A1 | 12/2016 |

* cited by examiner

DEVICE FOR A STEEL TUBE FOR USE IN A TUBULAR HYDROCARBON COLUMN

The present invention relates to the field of devices for metal tubes intended for use in a tubular column for oil & gas, energy or storage application such as operating hydrocarbon wells, geothermal or carbon capture, and more particularly to cable clamping devices.

The present invention particularly relates to a clamping device for supporting at least one cable, notably for a box portion of a metal tube intended for use in a tubular hydrocarbon column.

The present invention also relates to a metal tube equipped with such a clamping device.

A tubular hydrocarbon column or working string generally consists of a plurality of tubes attached together. More specifically, a tubular hydrocarbon column for hydrocarbon wells or similar wells generally comprises a tubing string and several casing strings. The tubing strings consists of a plurality of completion tubes accommodated inside the casing string. The casing string consists of a plurality of casing tubes arranged inside a drilling hole of the well. The casing tubes have a larger diameter cross-section than the diameter cross-section of the completion tubes and surround said completion tubes. In the lower part of the casing string, the casing tubes are also called liner tubes.

The casing strings are needed to maintain borehole stability, prevent contamination of water sands, and control well pressures during drilling, production, and/or workover operations.

The casing tubes and the completion tubes are made of steel and may be made, without limitation, according to API standards Specification 5CT or 5CRA for standard Casing and Tubing. For example, the steel is one of grade L80, P110 or Q125 standards.

Two tubes of a string may be attached by a threaded joint or connection. Typical threaded joint for connecting a first tube to a second tube may include a male threaded portion formed on the outer peripheral surface of the first tube, also called as a pin end, and a female threaded portion formed on the inner peripheral surface of the second tube, also called as a box end. The threaded portions cooperated so as to attach the first tube to the second tube, thus forming a threaded joint.

Another known type of threaded joint may include a coupling box for attaching a first tube and a second tube. Each first and second tube includes a pipe having, at both ends thereof, a male threaded portion formed on the outer peripheral surface, also called pin end. The first tube includes a coupling box having an inner hole provided with a female threaded portion formed on the inner periphery of the hole. The coupling box is generally previously connected to one end of the steel pipe by means of the male threaded portion of said end and the female threaded portion of the coupling box. By way of this arrangement, the first tube has a male threaded portion, also called a pin end, and a coupling box portion with a female threaded portion. The second tube may be attached to the first tube by means of the male threaded portion of said second tube and the female threaded portion of the coupling box.

Such threaded tubular connections are subjected to a variety of combination of stresses that may vary in intensity or change in direction, such as, for example, axial tension, axial compression, inner pressure bending force, torsional force, etc. . . . . Threaded tubular connections are thus generally designed to support those stresses, withstand rupture and provide tight sealing.

The solidity of a string of tubes thus generally relies on the absence of wear on the parts or portions forming the threaded connection or joint. It has therefore been proposed devices for protecting the threaded portions of tubes having a male threaded portion and a female threaded portion.

For operations on site, it is necessary to remove the protecting device prior to installing the tube in a well. It is preferable to remove the protecting device at the latest stages prior to installing the tube in the well. The protecting device then has to be unscrewed from the tube. These operations are particularly time consuming and demand a particular attention from operators who also have to manage tubes. The installation process of a column is thus rendered more complicated by the use of known protecting devices and weak points of a tube are not protected during installation of the column.

Furthermore, when mounting the male threaded portion of the second tube into the female threaded portion of the first tube, a stabbing guide is generally used. Such stabbing guide is positioned by an operator before inserting the end of the second tube into the end of the first tube and then removed before screwing the second tube in the first tube. Such operation also increases the operation time of installation of the column.

Moreover, tubular hydrocarbon columns may be installed either onshore of offshore drilling rings, and they can be used to support electric cables to power submersible equipment, such as pumps, safety valves and other downhole equipment. Tools called clamps are generally used to accommodate such electric cables. These clamps are usually installed on tubes, particularly on box couplings, and need generally a plurality of operators. Therefore, installation of such clamps on all box couplings of a column is time consuming on rigs, leading to costly operations.

There is thus a need to reduce the installation time of a column, also called the "critical path activity".

Indeed, said critical path activity is today around 200 seconds per tube, which leads to expensive installation operations, considering the high cost for a day rental of a rig.

The aim of the present invention is to overcome the aforementioned drawbacks.

It is a particular object of the present invention to improve the operations on site, particularly the easiness and speed of operations involving handling cross-clamping devices in view of reducing time needed for the installation process of tubes of a column on rigs.

The invention may also integrate a stabbing guide making alignment of ends of tubes easier and quicker.

According to another aspect, it is also an object of the invention to improve the protection of the coupling box portion of a tube intended to form a threaded joint during the installation process of the tube.

According to one aspect of the invention, it is proposed a device for a first steel tube designed to be secured on a portion of said tube used in a tubular hydrocarbon column for energy and storage applications such as operating hydrocarbon wells, geothermal and carbon capture. Said device comprises:

- a substantially cylindrical envelope extending along a longitudinal axis and designed to surround, protect and/or guide the portion of the first steel tube, said envelope forming an opened ring less than 360° so that a circumferential gap subsists between two free ends of said envelope; and
- a locking mechanism fixed to the envelope in the vicinity of the circumferential gap and configured to bring the free ends of the envelope closer to each other in a locked position, thereby firmly fixing said device on the first tube.

Advantageously, the locking mechanism comprises a locking lever pivotably mounted on the envelope and configured to rotate between an unlocked position in which said locking lever is radially away from the envelope and the locked position in which said locking lever rotates towards the envelope.

For example, said locking mechanism is further configured to clamp at least one cable while bringing the free ends of the envelope closer to each other in the locked position.

The cable may be an electric power cable, an electric communication cable, a control line, a hydraulic cable, a fiber optical cable, a chemical injection cable or any other cable.

The locking lever may be designed to clamp the at least one cable in the locked position.

Said locking mechanism is thus configured to reduce the circumferential gap of the envelope in the locked position.

For example, the radial cross-section of said envelope forms an arc of circle less than 360°, for example within a range comprised between 320° and 359°.

Furthermore, thanks to the device according to the invention, no tool is needed to fix it on the corresponding tube, and no tool is needed to clamp the cable, such that the critical path activity or installation time of a tube is significantly reduced, for example around 3 seconds to 5 seconds, which leads to a considerable cost reduction of the installation operations.

The device can be mounted before operations on rigs and do not hinder handling of tubes.

Advantageously, the envelope comprises at least one longitudinal groove extending along an axis parallel to the axis of the envelope, in the vicinity of the circumferential gap, said groove being configured to receive the at least one cable.

As an alternative, said outer circumferential surface of the envelope comprises two or more longitudinal parallel grooves, each groove being configured to receive at least one cable.

Alternatively, the longitudinal groove may be configured to receive two or more cables.

Said groove may come on both lateral ends of the envelope.

For example, the longitudinal groove may have a longitudinal length equal to the longitudinal length of the envelope.

As an alternative, the longitudinal groove comprises a first part and a second part coaxial with the first part, each of the first and second parts coming on one of both lateral ends of the envelope.

For example, the inner surface of the locking lever of the locking mechanism comprises a plurality of teeth or stretch marks configured to grip the cable in the locked position of the locking lever.

The teeth may be, for example, parallel to each other.

Advantageously, the locking mechanism comprises at least one transversal cap screw or locking rod attached to one of the free ends of the envelope and to the locking lever, said cap screw being located in a hollowed cavity provided in the other free end in the locked position of the locking mechanism.

Alternatively, the locking mechanism may comprise at least two parallel transversal cap screws, each of said cap screw being attached to one of the free ends of the envelope and to the locking lever and being located in a hollowed cavity provided in the other free end in the locked position of the locking mechanism.

Said device may comprise at least one longitudinal pivot axis or shaft extending along a rotational axis parallel to the longitudinal axis of the envelope, the locking lever being pivotably mounted on said shaft.

Alternatively, the device may comprise at least two coaxial longitudinal shafts, the locking lever being pivotably mounted on said shafts.

For example, the cap screw is fixed to the longitudinal shaft for the locking lever.

In an embodiment, the locking lever comprises an off-centred portion in the vicinity of the circumferential gap, said off-centred portion being offset compared to the rotational axis in such a way that when rotating the locking lever in the locked position, said off-centred shape comes in contact with the envelope, thereby pretensioning the cap screw.

The off-centred portion of the locking lever acts as a holding system. Indeed, when rotating the locking lever around the longitudinal rotational axis of said lever, said off-centred portion comes in contact with the envelope, in the vicinity of the second free end, thereby prestressing the cap screw.

Indeed, the cap screw, which is connected to the shaft of the lever, are slid in the corresponding hollowed cavity, thereby bringing the first free end towards the second free end of the envelope. In the locked position of the locking lever, the cap screw is pretensioned in such a way that the cap screw aims at returning to its initial position. The particular shape of the locking lever in the vicinity of the circumferential gap allows the locking lever to be maintained in the locked position In an embodiment, the envelope comprises at least two frames or shells articulated compared to each other between an opened position and a closed position in which said shells surround the first steel tube.

In an alternative, the envelope may comprise another number of articulated shells, for example three or more.

The shells are, for example, articulated through at least one hinge, for example, two or more hinges.

The outer circumferential surface of the envelope may comprise a recess designed to receive the locking lever of the locking mechanism in the locked position. In said locked position, the locking lever does not extend radially beyond the radial dimension of the envelope, such that said locking lever is not subjected to be damage when installing the tube in the casing.

For example, the locking lever has a rounded shape so as to match the shape of the outer circumferential surface of the envelope in the locked position. Such rounded shape reinforces the locking strength of the locking mechanism in the locked position.

The envelope is, for example, made of metallic material, such as for example, steel.

The locking lever of the locking mechanism is, for example, made of metallic material, or, for example in plastic material.

In an embodiment, the inner circumferential surface of the envelope comprises at least one anti-rotational tooth or rib in order to prevent rotation of said envelope compared to the first tube when the locking mechanism is in the locked position.

In an embodiment, the locking mechanism comprises a holding system configured to maintain the locking lever in the locked position.

The holding system may comprise, for example, a push-button pin mounted on the locking lever and configured to be insert in a corresponding hole provided on the envelop for maintaining the locking lever in the locked position. As an alternative, said push-button may also be mounted on the envelope and configured to be inserted in a corresponding hole provided on the locking lever. Other holding systems may also be used for maintaining the locking lever in the locked position.

In another embodiment, the holding system comprises an elastically deformable strand arranged in a safety clip provided on the locking lever configured to be elastically deformable between holding position in which the free ends of said strand are arranged in a corresponding slot provided in the envelope and a free position in which said free ends are away from said slots.

For example, the holding system comprises a first longitudinal portion extending along an axis substantially parallel to the longitudinal axis of the envelope and arranged in the safety clip, two transversal portions extending from the first longitudinal portion and each connected to a second and third coaxial longitudinal portions extending outwardly in a corresponding through-hole provided on the locking lever. The free ends of said second and third longitudinal portions are located in a corresponding slot when the holding system is in the holding position.

The holding system is thus capable, from the material used and/or its dimension, to be deformed under a slight solicitation, for example when pressing the two transversal portions of the holding system towards each other, and to return to its initial position when no solicitation is exerted said portions.

The holding system may be made in a flexible deformable and capable of bouncing back material, such as a thermoplastic, for example a low-density polyethylene (LDPE), a high-density polyethylene (HDPE), a thermoplastic elastomer (TPE), a thermoplastic polyurethane (TPU) or any material capable of being elastically deformed.

In another embodiment, the holding system comprises at least one lug extending from a free end of the locking lever, opposite to the cap screw, towards the envelope, the free end of said lug comprising an attachment pin configured to be arranged in a corresponding hole provided on the envelope when the locking lever is in the locked position.

For example, the holding system comprises two lugs extending from the free end of the locking lever, the free end of said lugs comprising an attachment pin configured to be arranged in a corresponding hole provided on the envelope when the locking lever is in the locked position.

Device according to any of the preceding claims, further comprising at least one radio frequency identification chip, or tracking device, or product marking.

The envelope may be radially inwardly delimited by an inner tapered surface. Said inner tapered surface may act as a stabbing guide for a second completion tube. For example, the inner tapered surface forming an angle within a range 20° to 70°, for example within a range 45° to 50°, with respect to the longitudinal axis of the outer circumferential surface of said envelope.

For example, the device further comprises a temporary protective closure covering the inner tapered surface of the envelope. Said protective closure aims at protecting the thread of the tubes during transport.

The protective closure may be made in plastic or metallic material.

For example, the device further comprising at least one radio frequency identification chip, or tracking device, or product marking.

For example, said radio frequency identification chip is located on a groove provided on the outer circumferential surface of the envelope.

According to another aspect, the invention concerns a steel tube intended for use in a tubular column for energy and storage application such as operating hydrocarbon wells, geothermal and carbon capture, preferably as a completion tube, said tube including a male portion and a box portion configured to receive a male portion of another second steel tube, and a device as described above.

According to another aspect, the invention concerns a tubular hydrocarbon column comprising a first tube including a first pin portion and a first box portion, a second tube including a second pin portion configured to be screwed into the first bow portion and a second box portion, and at least one device as described above mounted so as to be secured on the first box portion of the first tube.

The present invention and its advantages will be better understood by studying the detailed description of a specific embodiment given by way of non-limiting examples and illustrated by the appended drawings on which:

FIG. 1 is a perspective view of a cable clamping device according to an embodiment of the invention, mounted on a first tube and having a locking lever in a locked position of a cable;

FIG. 2*a* is the device of FIG. 1 with the locking lever in an unlocked position;

FIG. 2*b* illustrates the device of FIG. 1 with a temporary protective closure;

FIG. 3*a* is front view of the device of FIG. 1;

FIG. 3*b* is a detailed view of FIG. 3*a;*

FIG. 4*a* is an upper view of the device of FIG. 3*a;*

FIG. 4*b* is another embodiment of the device of FIG. 4*a;*

In the following description, the terms "longitudinal, "transversal", "vertical", "front", "rear", "left" and "right" are defined according to a usual orthogonal benchmark as shown on the drawings, which includes:

- a longitudinal axis X, horizontal and left to the right of front views;
- a transversal axis Y, perpendicular to the longitudinal axis X and extending from the rear to the front of front views; and
- a vertical axis Z, orthogonal to the longitudinal and transversal axis X and Y.

An embodiment of a cable clamping device 10 is illustrated on the FIGS. 1 to 9; said cable clamping device 10 extends along a longitudinal axis A1 and is designed to be mounted on a first tube 20, such as a completion tube, before operations on rigs.

The first tube 20 is coaxial with the cable clamping device along the longitudinal axial A1. The first tube 20 is substantially cylindrical and comprises a first lower end (not shown), also called a pin portion, having male threads (not shown) provided on the outer circumferential surface of said first lower end. The first tube 20 further comprises a second upper end 22, opposite to the first lower end, also called a box portion, having female threads 22*a* provided on the inner circumferential surface of said box portion.

Figure 7:
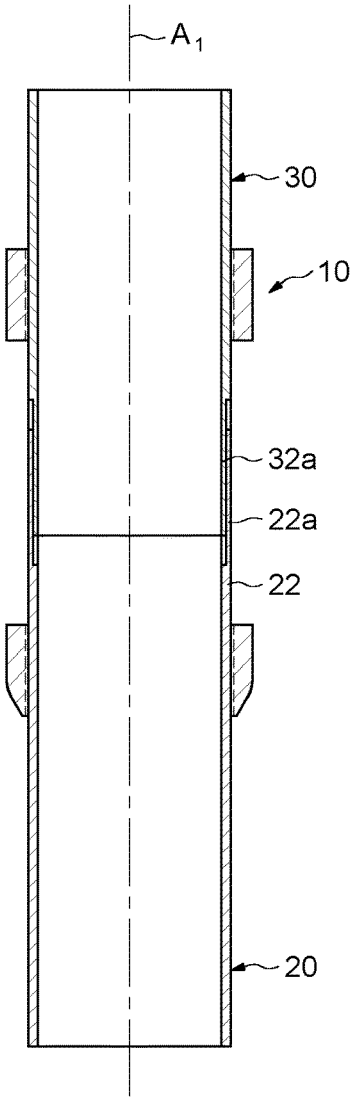
FIG. 7 is a longitudinal cross-section view along line VII-VII of FIG. 4*a;*

The male threaded portion of the first lower end of the first tube 20 is designed to cooperate with a female threaded portion of a lower tube (not shown) and the female threaded portion 22 of said first tube 20 is designed to cooperate with male threads 32*a* of a male threaded portion 32 of an upper tube 30 as shown on FIG. 7.

The cable clamping device 10 is mounted around the second upper end 22 of the first tube 20. As an alternative, the first tube may be a coupling box forming a sleeve having a substantially cylindrical shape and having inner female threads provided on its inner circumferential surface designed to cooperate with male threads of a lower tube (not shown) and with male threads of an upper following tube 30.

The device 10 comprises a cylindrical envelope 11, for example in metal material, such as steel. The envelope 11 is radially inwardly delimited by an inner cylindrical surface 11*a* having a diameter substantially equal to the outer diameter of the first tube 20.

The envelope 10 is further radially outwardly delimited by an outer cylindrical surface 11*b* and circumferentially delimited by two tangential free ends 11*c*, 11*d*.

As can be seen of FIG. 4, the radial cross-section of the envelope 11 forms an arc of circle about an angle α. The angle α is chosen in such a way that the tangential free ends 11*c*, 11*d* of the radial cross-section of the envelope 11 are circumferentially spaced by a circumferential gap J1. The angle α is less than 360°, for example within a range of 320° to 359°, for example within 320° to 350°.

The envelope 11 is designed to surround the box portion 22 of the first tube 20. However, the envelope may be mounted on any portion of a tube.

The envelope 11 is further delimited by two lateral ends 11*e*, 11*f*.

Figure 3A:
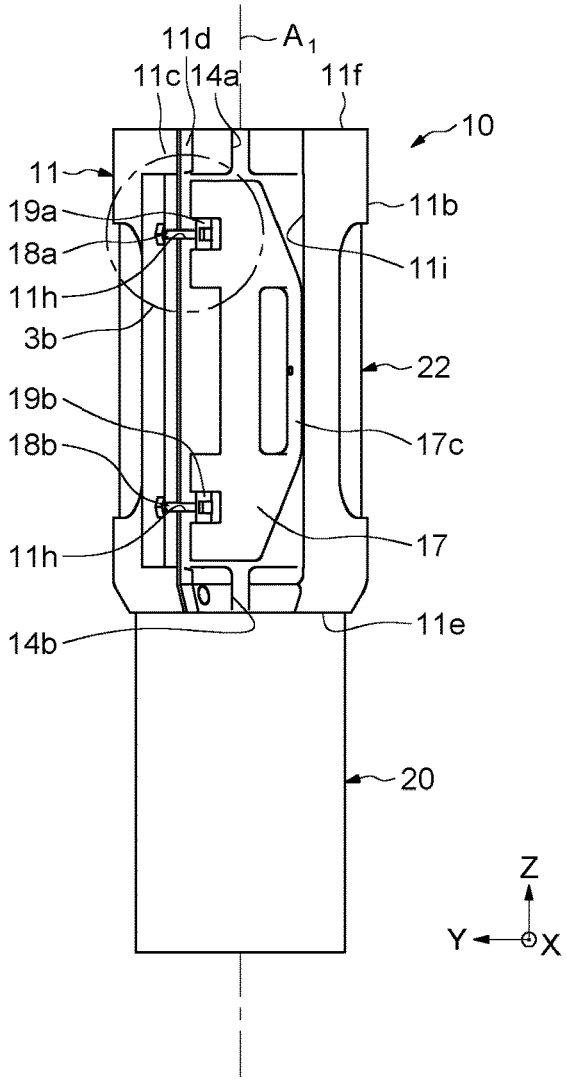
Figure 4A:
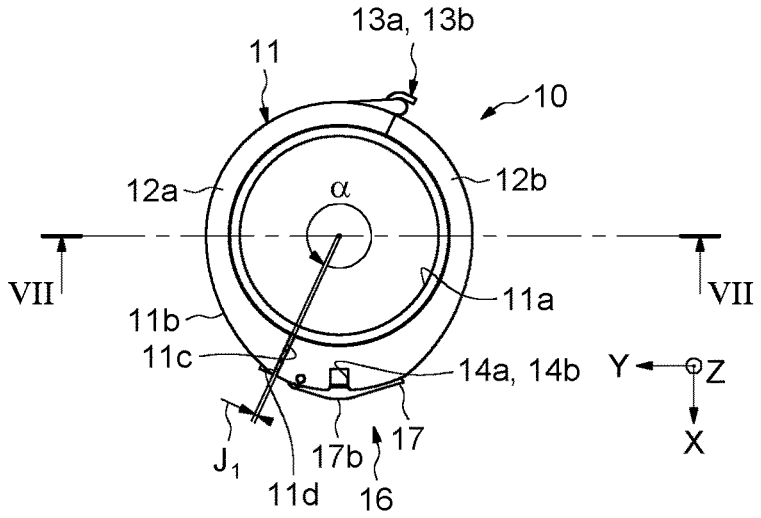
Figure 4B:
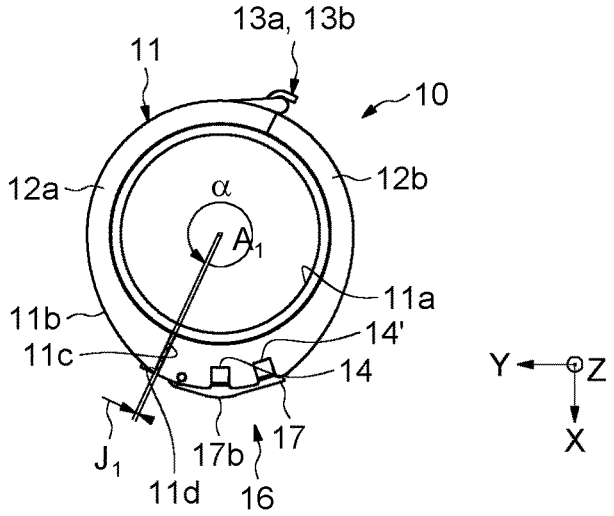
Figure 5:
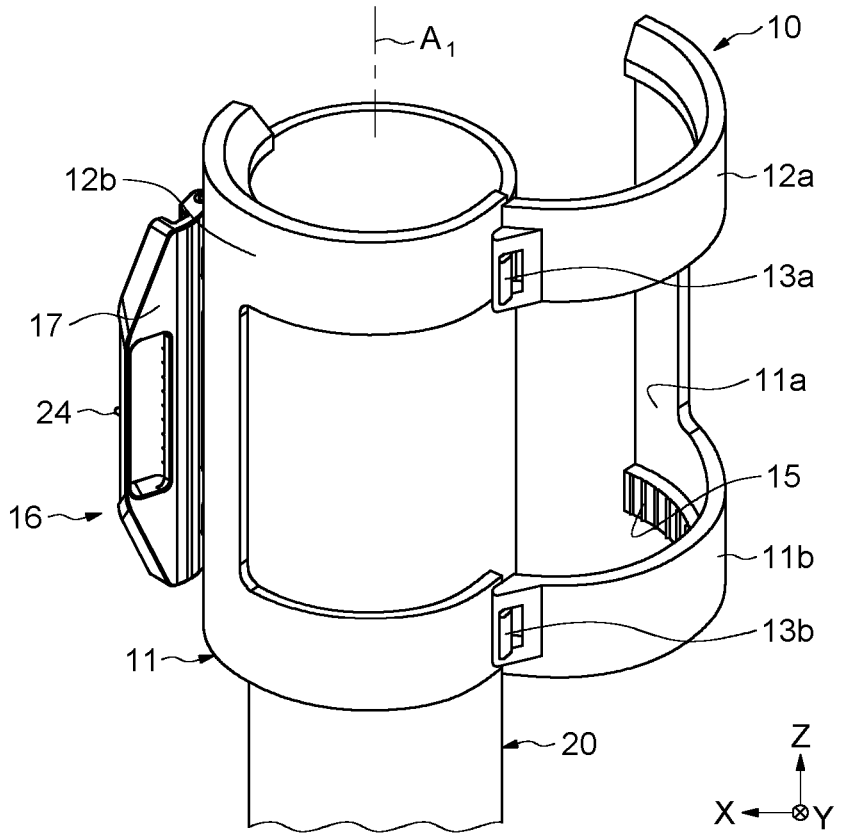
FIG. 5 is the device of FIG. 2*a* in an opened position before being mounted on the first tube.

As illustrated, the envelope 11 comprises two substantially cylindrical shells 12*a*, 12*b* articulated compared to each other between a closed position, shown on FIGS. 1 to 4 in which said shells surround the first steel tube 20 and an opened position as shown on FIG. 5.

As an alternative, the envelope may comprise another number of articulated shells, for example three or more. The envelope may also comprise a single shell slidingly mounted on the first tube.

The shells are articulated through two hinges 13*a*, 13*b*, alternatively, the shells may be articulated through one hinge or more than three hinges.

The outer circumferential surface 11*b* of the envelope 11 comprises one longitudinal groove 14 comprising two coaxial longitudinal groove parts 14*a*, 14*b*, in the vicinity of the circumferential gap J1. Said groove parts 14*a*, 14*b* is configured to receive the least one cable 40.

Each of said groove parts 14*a*, 14*b* comes on one of both lateral ends 11*e*, 11*f* of the envelope 11.

The cable 40 may be an electric cable, a control line, a hydraulic cable or a fiber optical cable.

As an alternative, said outer circumferential surface 11*b* of the envelope 11 may comprise two or more longitudinal parallel grooves 14, 14' as shown on FIG. 4*a*, each groove 14, 14' being configured to receive at least one cable.

Alternatively, each longitudinal groove may be configured to receive two or more cables.

The envelope is further radially inwardly delimited by an inner tapered surface 11*g*. Said inner tapered surface acts as a stabbing guide for a second completion tube 30. For example, the inner tapered surface 11*g* forms an angle within a range 20° to 45° with respect to the longitudinal axis A1 of the outer circumferential surface 11*b* of said envelope 11.

Figure 2A:
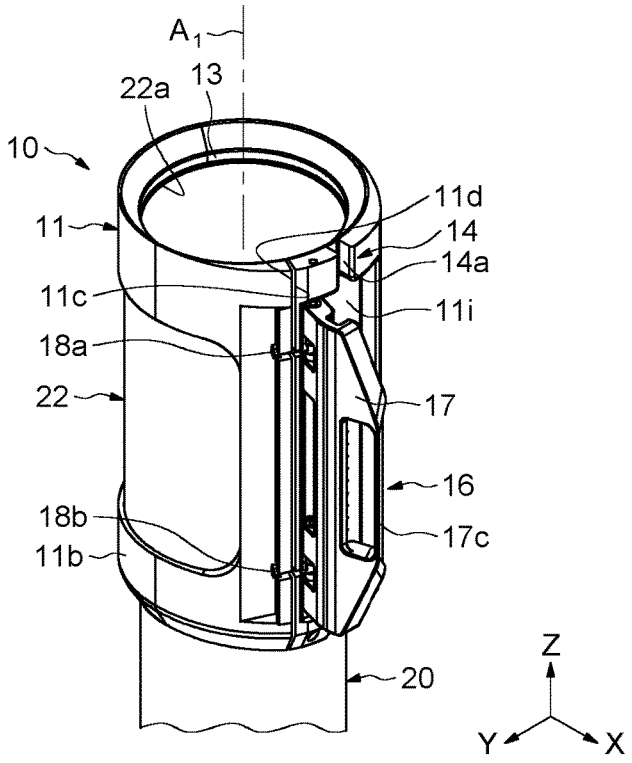

As can be seen on FIG. 2*a*, the device 10 comprises a temporary protective closure 13 covering the inner tapered surface 11*g* of the envelope 11. Said protective closure 13 aims at protecting the thread of the tubes during transport.

As can be seen on FIG. 5, the inner circumferential surface 11*a* of the envelope 11 comprises a plurality of parallel anti-rotational teeth 15 in order to prevent rotation of said envelope 11 compared to the first tube 20 when locked on said first tube 20.

The device 10 further comprises a locking mechanism 16 fixed to the envelope 11 in the vicinity of the circumferential gap J1.

Figure 1:
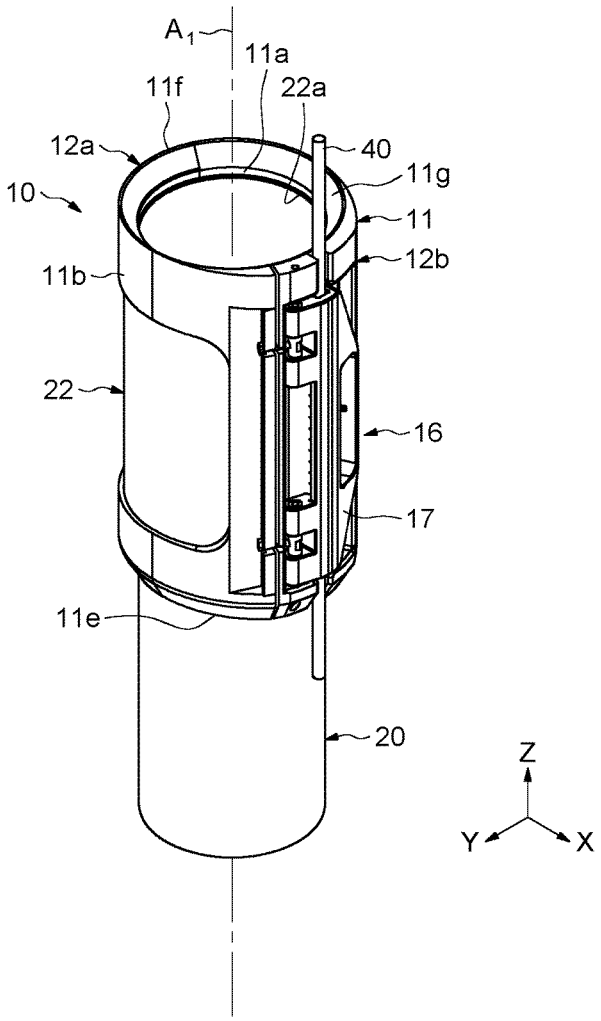
Figure 2B:
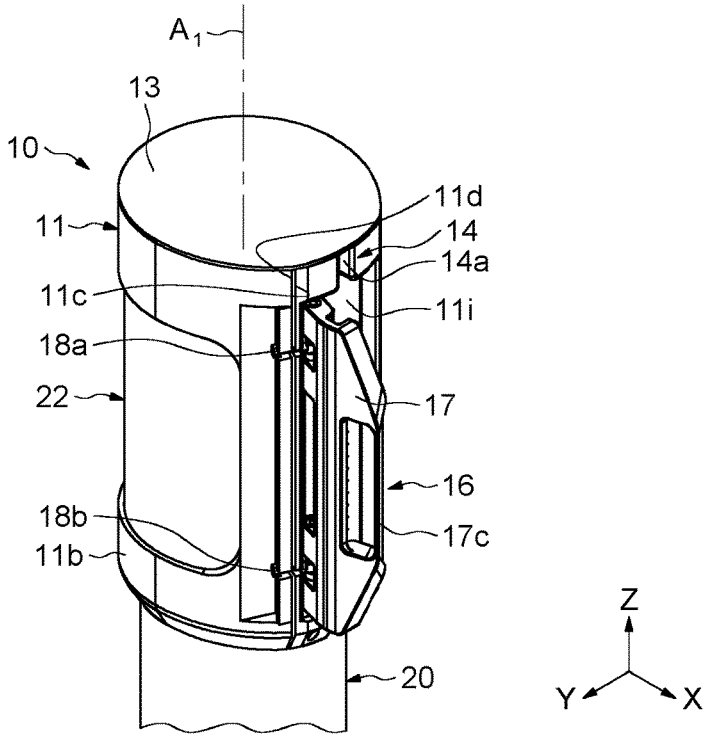
Figure 3B:
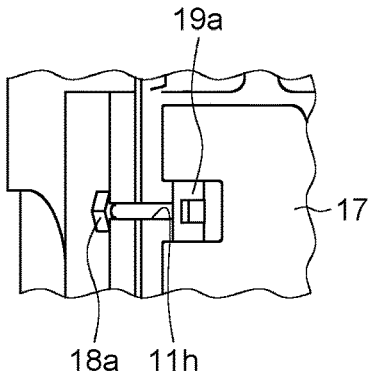
Figure 6:
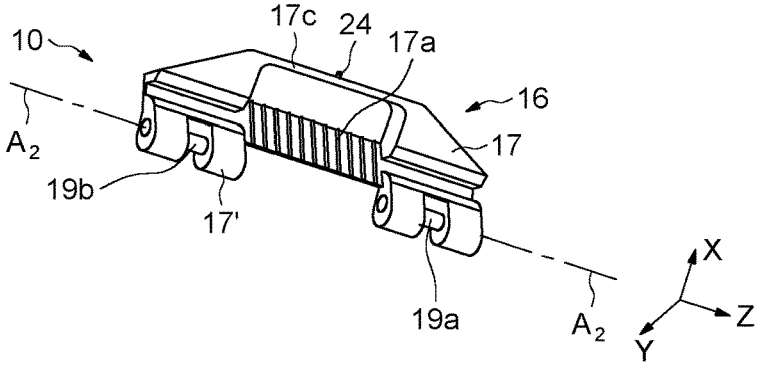
FIG. 6 is a detailed view of the device of FIG. 2*a;*

Said locking mechanism 16 comprises a locking lever 17 pivotably mounted on the envelope 11 between a locked position, shown on FIGS. 1, 3 and 4, in which said locking lever 17 rotates towards the envelope 11 and clamps the cable 40, shown on FIG. 1, and an unlocked position, shown on FIGS. 2, 5 and 6, in which said locking lever is radially away from the envelope 11. The locking mechanism 17 is configured to reduce the circumferential gap J1, shown on FIGS. 4*a* and 4*b* of the envelope 11 in the locked position.

In other words, in the locked position, the locking mechanism 16 is configured to circumferentially bring the free ends 11*c*, 11*d* of the envelope 11 closer to each other, thereby firmly fixing said device 10 on the first tube 20, notably through the anti-rotational teeth 15 of the envelope 11.

The locking mechanism 16 comprises two parallel transversal cap screws 18*a*, 18*b* attached to one of the free ends 11*c* of the envelope 11 and to the locking lever 17. As a non-limiting example, the cap screw may be screws or rods.

Each cap screw 18*a*, 18*b* is slid in a corresponding through-hole 11*h* provided in the other free end 11*d* of the envelope 11 in the locked position of the locking lever 17. Alternatively, the locking mechanism may comprise at least one transversal cap screw, or more than two parallel cap screws. The hollowed cavity is here a through-hole 11*h* but may be a slot or a notch or have any other shape designed to let the cap screws 18*a*, 18*b* pass through.

The locking mechanism 16 further comprises two coaxial longitudinal shafts 19*a*, 19*b*, shown in detail on FIG. 6. The shafts 19*a*, 19*b* extend along a rotational axis A2 parallel to the longitudinal axis A1 of the envelope 11. Said locking lever 17 is pivotably mounted on said shafts 19*a*, 19*b*. The cap screws 18*a*, 18*b* are attached to the corresponding shafts 19*a*, 19*b*.

The cross-section of the locking lever 17 in the vicinity of the circumferential gap J1 has an off-centred portion 17' compared to the rotational axis A2, such that when rotating the locking lever 17 around the longitudinal rotational axis A2 of the lever, passing through the shafts 19*a*, 19*b*, the locking lever 17 comes in contact with the envelope 11, in the vicinity of the second free end 11*d*, thereby displacing the shafts 19*a*, 19*b*. The cap screws 18*a*, 18*b*, which are connected to said shafts 19*a*, 19*b*, are slid in the corresponding hollowed cavity, thereby bringing the first free end 11*c* towards the second free end 11*d* of the envelope 11. The particular shape of the locking lever 17 in the vicinity of the circumferential gap allows the locking lever to be maintained in the locked position. Said off-centred portion 17' of the locking lever 17 thus acts as a holding system of the locking lever in the locked position by pretensioning the screw caps 18*a*, 18*b*.

Alternatively, the device may comprise at least one longitudinal shaft fixed to the envelope 11, the locking lever 17 being pivotably mounted on said shaft.

As shown on FIG. 6, the inner surface (not referenced) of the locking lever 17 of the locking mechanism 16 comprises a plurality of parallel teeth 17*a* or stretch marks configured to grip the cable 40 in the locked position of the locking lever 17.

As shown on FIGS. 4*a* and 4*b*, the outer surface 17*b* of the locking lever 17 has a rounded shape so as to match the shape of the outer circumferential surface 11*b* of the envelope 11 in the locked position of the locking lever 17.

As illustrated on FIG. 3*a*, the locking lever 17 comprises a handling portion 17*c*, opposite to the locking rods 18*a*, 18*b*, in order to easily manipulate said locking lever 17.

The locking lever 17 of the locking mechanism 16 is, for example, made of metallic material. Said locking lever 17 may also be made in plastic material.

The locking mechanism 16 further comprises an additional holding system 24, shown on FIG. 6, configured to maintain the locking lever 17 in the locked position. For example, the holding system 24 comprises a push-button pin mounted on the locking lever 17 and configured to be insert in a corresponding hole (no referenced) provided on the envelop 11 for maintaining said locking lever 17 in the locked position. As an alternative, said push-button may also be mounted on the envelope and configured to be inserted in a corresponding hole provided on the locking lever. The holding system is not limited to such an example and may comprise any other elements configured to maintain the locking lever in the locked position.

Figure 8:
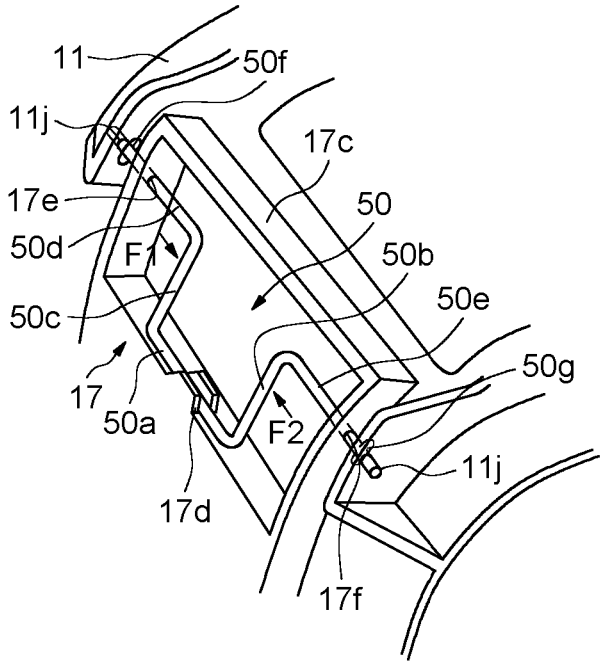
FIGS. 8 and 9 are examples of holding mechanisms of the locking lever in the locked position.

Another example of a holding system 50 of the locking lever 17 in the locked position is described in reference to FIG. 8.

The holding system 50 has the general shape of a thin strand configured to be elastically deformable between a free position in which the locking lever is not maintained in the locked position and a holding position in which the locking lever is maintained in the locked position. The holding position corresponds to the rest position of the holding system 50.

The holding system 50 may be made in a flexible deformable and capable of bouncing back material, such as a thermoplastic, for example a low-density polyethylene (LDPE), a high-density polyethylene (HDPE), a thermoplastic elastomer (TPE), a thermoplastic polyurethane (TPU) or any material capable of being elastically deformed.

The holding system 50 comprises a first longitudinal portion 50*a* extending along an axis substantially parallel to the longitudinal axis A1 of the envelope 11. Said first longitudinal portion 50*a* is arranged in a safety clip 17*d* provided on the locking lever 17.

The holding system 50 comprises two transversal portions 50*b*, 50*c* extending from the first longitudinal portion 50*a* towards the handling portion 17*c* and each connected to a second and third longitudinal portions 50*d*, 50*e*. The second and third longitudinal portions 50*d*, 50*e* are coaxial and extend outwardly in a corresponding through-hole 17*e*, 17*f* provided on the locking lever 17.

The free ends of each second and third longitudinal portions 50*d*, 40*e* are located in a corresponding slot 11*j* provided in the envelope 11 when the holding system 50 is in the holding position, as shown on FIG. 8.

The free ends of each second and third longitudinal portions 50*d*, 50*e* may be provided with a retaining ring 50*f*, 50*g* located between the envelope 11 and the lever 17 for retaining said holding system 50.

When pressing, along arrows F1 and F2, the two transversal portions 50*b*, 50*c* of the holding system 50 towards each other, the second and third longitudinal portions 50*d*, 50*e* are translated towards each other, thereby unlocking the free ends of said holding system 50 from the slots 11*j* provided on the envelope 11.

The holding system 50 is configured to return to its rest position when no solicitation is exerted on the two transversal portions 50*b*, 50*c*.

In other words, the holding system is thus capable, from the material used and/or its dimension, to be deformed under a slight solicitation, for example when pressing, along arrows F1 and F2, the two transversal portions 50*b*, 50*c* of the holding system 50 towards each other, and to return to its initial position when no solicitation is exerted said portions.

Figure 9:
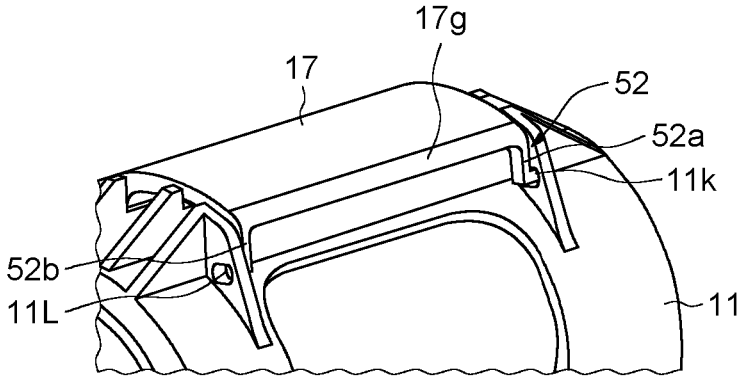

Another example of a holding system 52 of the locking lever 17 in the locked position is described in reference to FIG. 9.

The locking lever 17 is provided with a free end 17*g*, opposite to the locking rods 18*a*, 18*b*.

The holding system 52 comprises two parallel lugs 52*a*, 52*b* extending from the free end 17*g* of the locking lever 17 towards the envelope 11. Each free end of the lugs 52*a*, 52*b* comprises an attachment pin (not referenced) configured to be located in a corresponding hole 11*k*, 11L provided on the envelope when the locking lever is maintained in the locked position.

Alternatively, the holding system 52 could comprise a single lug

The outer circumferential surface 11*b* of the envelope 11 comprises a recess 11*i* designed to receive the locking lever 17 of the locking mechanism 16 in the locked position. As can be seen on FIG. 4, in said locked position, the locking lever 17 does not extend radially beyond the radial dimension of the envelope 11, such that said locking lever is not subjected to be damage when installing the tube in the casing.

The groove 14 for the cable 40 comes out into the recess 11*i* for the locking lever 17.

Figure 10:
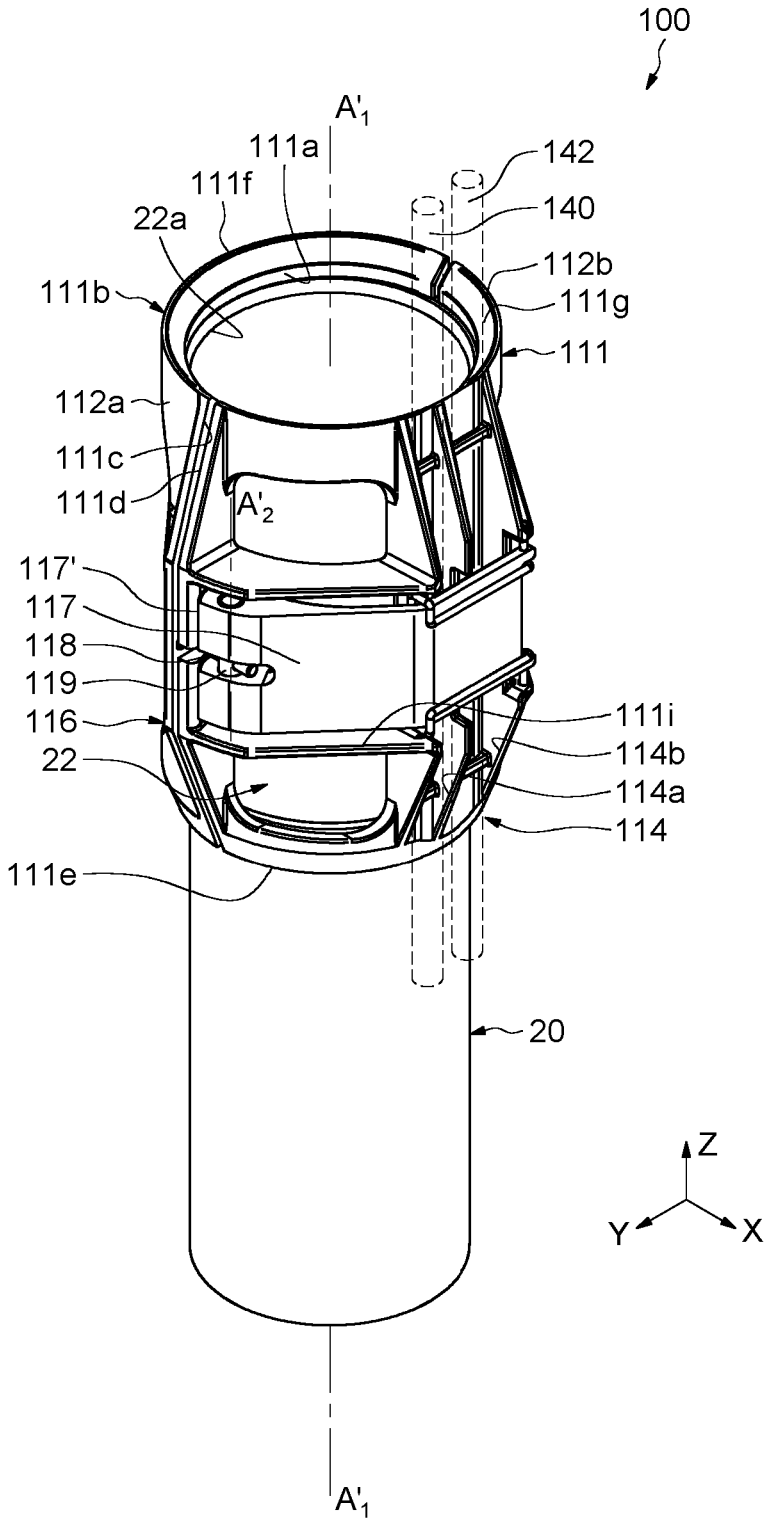
FIG. 10 is a perspective view of a cable clamping device according to another embodiment of the invention, mounted on a first tube and having a locking lever in a locked position of a cable.
Figure 11:
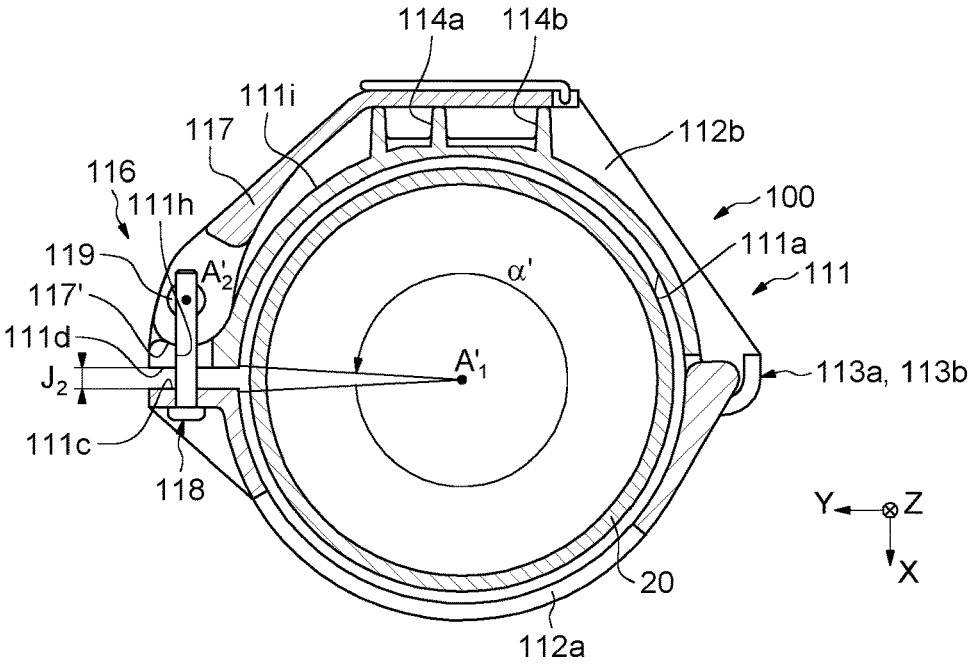
FIG. 11 is a cross section of the device FIG. 10 showing a locking lever of a locking mechanism in a locked position.
Figure 12:
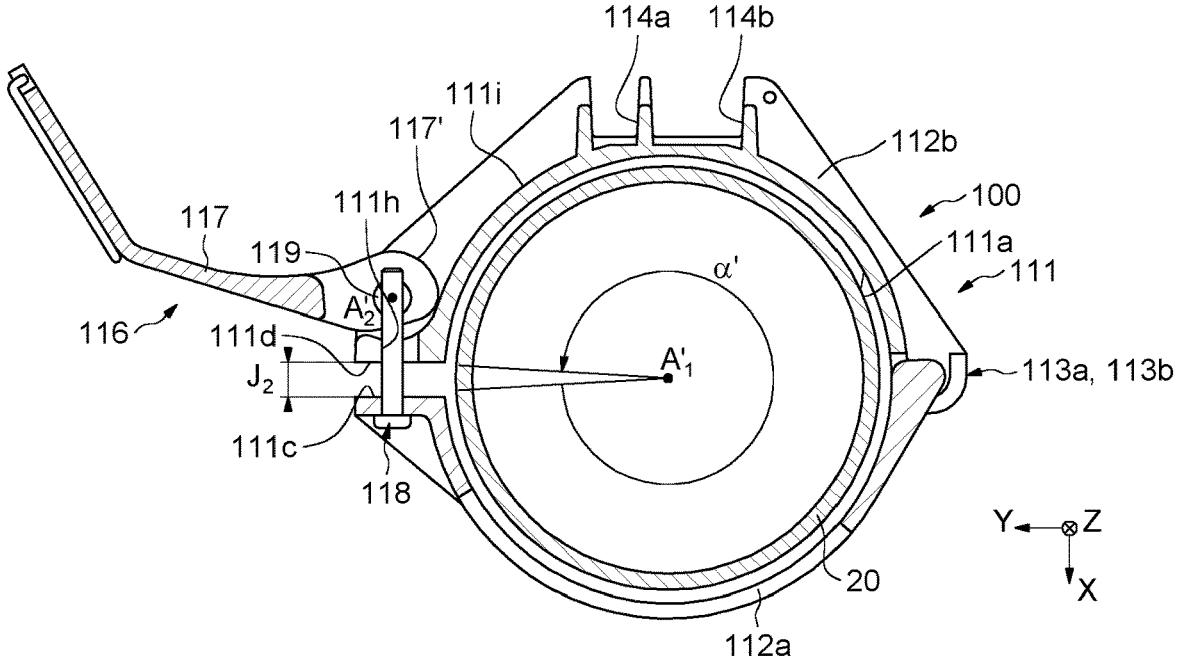
FIG. 12 is a cross section of the device FIG. 10 showing the locking lever of the locking mechanism in an unlocked position.

Another embodiment of a cable clamping device 100 is illustrated on the FIGS. 10 to 12; said cable clamping device 100 is similar to the cable clamping device 10 of FIGS. 1 to 9. The cable clamping device 100 extends along a longitudinal axis A' 1 and is designed to be mounted on the first tube 20, notably around the second upper end 22 of the first tube 20.

The device 100 comprises a cylindrical envelope 111, for example in metal material, such as steel. The envelope 111 is radially inwardly delimited by an inner cylindrical surface 111*a* having a diameter substantially equal to the outer diameter of the first tube 20.

The envelope 100 is further radially outwardly delimited by an outer cylindrical surface 111*b* and circumferentially delimited by two tangential free ends 111*c*, 111*d*.

As can be seen of FIG. 11, the radial cross-section of the envelope 111 forms an arc of circle about an angle α'. The angle α' is chosen in such a way that the tangential free ends 111*c*, 111*d* of the radial cross-section of the envelope 111 are circumferentially spaced by a circumferential gap J2. The angle α' is less than 360°, for example within a range of 320° to 359°, for example within 320° to 350°.

The envelope 111 is designed to surround the box portion 22 of the first tube 20. However, the envelope may be mounted on any portion of a tube.

The envelope 111 is further delimited by two lateral ends 111*e*, 111*f*.

As illustrated, the envelope 111 comprises two substantially cylindrical shells 112*a*, 112*b* articulated compared to each other between a closed position, shown on FIGS. 10 and 11 in which said shells surround the first steel tube 20 and an opened position as shown on FIG. 12.

As an alternative, the envelope may comprise another number of articulated shells, for example three or more. The envelope may also comprise a single shell slidingly mounted on the first tube.

The shells are articulated through two hinges 113*a*, 113*b*, alternatively, the shells may be articulated through one hinge or more than three hinges.

The outer circumferential surface 111*b* of the envelope 111 comprises two longitudinal parallel grooves 114*a*, 114*b* in the vicinity of the circumferential gap J2. Each groove 114*a*, 114*b* is configured to receive at least one cable 140, 142.

Each of said grooves 114*a*, 114*b* comes on one of both lateral ends 111*e*, 111*f* of the envelope 111.

The cables 140, 142 may be electric cables, control lines, hydraulic cables or fiber optical cables. The cables may be of the same type or of a different type.

Alternatively, each longitudinal groove may be configured to receive two or more cables.

The envelope 111 is further radially inwardly delimited by an inner tapered surface 111*g*. Said inner tapered surface acts as a stabbing guide for a second completion tube 30. For example, the inner tapered surface 111*g* forms an angle within a range 20° to 45° with respect to the longitudinal axis A'1 of the outer circumferential surface 111*b* of said envelope 111.

The inner circumferential surface 111*a* of the envelope 111 may comprise a plurality of parallel anti-rotational teeth (not shown) in order to prevent rotation of said envelope 111 compared to the first tube 20 when locked on said first tube 20.

The device 100 further comprises a locking mechanism 116 fixed to the envelope 111 in the vicinity of the circumferential gap J2.

Said locking mechanism 116 comprises a locking lever 117 pivotably mounted on the envelope 111 between a locked position, shown on FIGS. 10 and 11, in which said locking lever 117 rotates towards the envelope 111 and clamps the cables 140, 142 and an unlocked position, shown on FIG. 12, in which said locking lever 117 is radially away from the envelope 111. The locking mechanism 117 is configured to reduce the circumferential gap J2 of the envelope 111 in the locked position.

In other words, in the locked position, the locking mechanism 116 is configured to circumferentially bring the free ends 111*c*, 111*d* of the envelope 111 closer to each other, thereby firmly fixing said device 100 on the first tube 20, notably through the anti-rotational teeth of the envelope 111.

The locking mechanism 116 comprises one transversal cap screws 118 attached to one of the free ends 111*c* of the envelope 111 and to the locking lever 117. As a non-limiting example, the cap screw may be screws or rods.

The cap screw 118 is slid in a corresponding through-hole 111*h* provided in the other free end 111*d* of the envelope 111 in the locked position of the locking lever 117. Alternatively, the locking mechanism 116 may comprise two parallel transversal cap screws, or more than two parallel cap screws. The hollowed cavity is here a slot or notch 111*h* but may be a through-hole or have any other shape designed to let the cap screw 118 pass through.

The locking mechanism 116 further comprises one longitudinal shaft 119. The shaft 119 extends along a rotational axis A'2 parallel to the longitudinal axis A'1 of the envelope 111. The locking lever 117 is pivotably mounted on said shaft 119. The cap screw 118 is attached to the shaft 119.

As can be seen on FIGS. 11 and 12, the cross-section of the locking lever 117 in the vicinity of the circumferential gap J2 has an off-centred portion 117' compared to the rotational axis A'2, such that when rotating the locking lever 117 around the longitudinal rotational axis A'2 of the lever 117, passing through the shaft 119, the locking lever 117 comes in contact with the envelope 111, in the vicinity of the second free end 111*d*, thereby displacing the shaft 119. The cap screw 118, which is connected to said shaft 119, is slid in the corresponding hollowed cavity, thereby bringing the first free end 111*c* towards the second free end 111*d* of the envelope 111. The particular shape of the locking lever 117 in the vicinity of the circumferential gap J2 allows the locking lever to be maintained in the locked position. Said off-centred portion 117' of the locking lever 117 thus acts as a holding system of the locking lever in the locked position by pretensioning the screw cap 118.

Alternatively, the device may comprise two or more parallel longitudinal shafts, the locking lever 117 being pivotably mounted on said shafts.

The inner surface (not referenced) of the locking lever 117 of the locking mechanism 116 may comprise a plurality of parallel teeth (not shown) or stretch marks configured to grip the cables 140, 142 in the locked position of the locking lever 117.

The outer circumferential surface 111*b* of the envelope 111 comprises a recess 111*i* designed to receive the locking lever 117 of the locking mechanism 116 in the locked position. As can be seen on FIG. 11, in said locked position, the locking lever 117 does not extend radially beyond the radial dimension of the envelope 111, such that said locking lever is not subjected to be damage when installing the tube in the casing.

As shown on FIG. 11, the outer surface (not referenced) of the locking lever 117 has a rounded shape so as to match the shape of the outer circumferential surface 111*b* of the envelope 111 in the locked position of the locking lever 117.

The locking lever 117 of the locking mechanism 116 is, for example, made of metallic material. Said locking lever 117 may also be made in plastic material.

The locking mechanism 116 may further comprise additional holding systems, such as the holding system 24, shown on FIG. 6, the holding system 50 described in reference to FIG. 8 or the holding system 52 described in reference to FIG. 9. As can be seen on the Figures, the envelope 11, 111 may comprise material recessed portions (not referenced) in order to reduce the weight of the device 10, 100.

The device 10, 100 may further include a radio frequency identification chip (RFID chip) (not shown), for example located in a groove on the outer surface of the envelope 11, 111. The chip may include data such as the dimensions of the tube and/or the threaded portions. By virtue of the chip, it is not necessary to remove the device from the tube in order to determine such data.

The device 10, 100 may also include sensors (not shown), such as pressure sensors, temperatures sensors in order to monitor the pressure exerted on the box portion 22 of the tube 20 and/or of the drilling fluid or cement, as well as the temperature of said box portion and/or of the drilling fluid or cement.

The completion tube 20 may be equipped with the device 10 immediately after its manufacture, before installation on a rig. The device 10, 100 may fully protect the box portion 22 of the tube 20 during transport and storage of said tube and may therefore be considered as a protective device.

After installation of the first completion tube 20, a following completion tube 30 may be guided by the funnel formed by the surface, so that the male threaded portion 32 of said following completion tube 30 is inserted in the box portion 22 of the first tube 20. The device thus acts as a stabbing guide for a following completion tube, without the need of additional tools. The first and second tubes are metal tubes intended for use in a tubular hydrocarbon column.

The device 10, 100 according to the invention is a multi-purpose tool configured to clamp cables, protect the box portion of a tube and to guide the insertion of the male threaded portion of a second tube into the female threaded portion of a first tube. Said device has thus three functions and does not need to be removed before installation of the completion tube into the casing.

Furthermore, thanks to the device according to the invention, no tool is needed to fix it on the corresponding tube, and no tool is needed to clamp the cables, such that the critical path activity or installation time of a tube is significantly reduced, for example around 3 seconds to 5 seconds, which leads to a considerable cost reduction of the installation operations. The device thus facilitates installation process of tubes in a casing string or in a drill hole.

The invention claimed is:

1. A device for a first steel tube designed to be secured on a portion of said tube used in a tubular column for oil & gas, energy, or storage applications, said device comprising:

a substantially cylindrical envelope extending along a longitudinal axis and designed to surround the portion of the first steel tube, said envelope forming an open ring so that a circumferential gap subsists between two free ends of said envelope; and a locking lever fixed to the envelope in the vicinity of the circumferential gap and configured to clamp at least one cable while bringing the free ends of the envelope closer to each other in a locked position, wherein the locking lever is pivotably mounted on the envelope and configured to rotate between an unlocked position in which said locking lever is radially away from the envelope and the locked position, and wherein the inner surface of the locking lever of the locking lever includes a plurality of teeth configured to grip the at least one cable.

2. The device according to claim 1, wherein the locking lever is designed to clamp the cable in the locked position.

3. The device according to claim 1, wherein the envelope comprises at least one longitudinal groove, extending along an axis parallel to the axis of the envelope, in the vicinity of the circumferential gap, said groove being configured to receive the at least one cable.

4. The device according to claim 1, wherein the locking lever comprises at least one transversal cap screw attached to one of the free ends of the envelope and to the locking lever, said cap screw being located in a hollowed cavity provided in the other free end of the envelope in the locked position of the locking lever.

5. The device according to claim 4 wherein the cap screw is fixed to a longitudinal shaft for the locking lever.

6. The device according to claim 5, wherein the locking lever comprises an off-centred portion in the vicinity of the circumferential gap, said off-centred portion being offset compared to the rotational axis in such a way that when rotating the locking lever in the locked position, said off-centred shape comes in contact with the envelope, thereby pretensioning the cap screw.

7. The device according to claim 1, comprising at least one longitudinal shaft extending along a rotational axis parallel to the longitudinal axis of the envelope, the locking lever being pivotably mounted on said shaft.

8. The device according to claim 1, wherein the envelope comprises at least two shells articulated compared to each other between an opened position and a closed position in which said shells configured to surround the first steel tube.

9. The device according to claim 8, wherein the shells are articulated through at least one hinge.

10. The device according to claim 1, wherein the outer circumferential surface of the envelope comprises a recess designed to receive the locking lever of the locking lever in the locked position.

11. The device according to claim 1, wherein the locking lever has a rounded shape so as to match the shape of the outer circumferential surface of the envelope in the locked position.

12. The device according to claim 1, wherein the envelope is made of metallic material.

13. The device according to claim 1, wherein the locking lever of the locking lever is made of metallic material.

14. The device according to claim 1, wherein the inner circumferential surface of the envelope comprises at least one anti-rotational tooth.

15. The device according to claim 1, wherein the locking lever comprises a holding system configured to maintain the locking lever in the locked position.

16. The device according to claim 15, wherein the holding system comprises an elastically deformable strand arranged in a safety clip provided on the locking lever configured to be elastically deformable between holding position in which the free ends of said strand are arranged in a corresponding slot provided in the envelope and a free position in which said free ends are away from said slots.

17. The device according to claim 16, wherein the holding system comprises a first longitudinal portion extending along an axis substantially parallel to the longitudinal axis of the envelope and arranged in the safety clip, two transversal portions extending from the first longitudinal portion and each connected to a second and third coaxial longitudinal portions extending outwardly in a corresponding through-hole provided on the locking lever, the free ends of said second and third longitudinal portions being located in a corresponding slot when the holding system is in the holding position.

18. The device according to claim 15, wherein the holding system comprises at least one lug extending from a free end of the locking lever, opposite to the cap screw, towards the envelope, the free end of said lug comprising an attachment pin configured to be arranged in a corresponding hole provided on the envelope when the locking lever is in the locked position.

19. The device according to claim 1, further comprising at least one radio frequency identification chip.

20. The device according to claim 1, wherein the envelope comprises an inner tapered surface.

21. The device according to claim 20, comprising a protective closure covering the inner tapered surface of the envelope.

22. A steel tube intended for use in a tubular hydrocarbon column, preferably as a completion tube, said tube including a pin portion and a box portion configured to receive a pin portion of another second steel tube, and a device according to claim 1.

23. A tubular hydrocarbon column comprising a first tube including a first pin portion and a first box portion, a second tube including a second pin portion configured to be screwed into the first box portion and a second box portion, and at least one device according to claim 1 mounted so as to be secured on the first box portion of the first tube.

* * * * *